US005685911A

United States Patent [19]

Raterman et al.

[11] Patent Number: 5,685,911

[45] Date of Patent: *Nov. 11, 1997

[54] APPARATUS FOR INTERMITTENTLY APPLYING DISCRETE ADHESIVE COATINGS

[75] Inventors: John Raterman, Lawrenceville, Ga.; Jurgen Benecke, Brandenburger, Germany; Arthur Cieplik, Luneburg, Germany; Thomas Burmester, Bleckede, Germany; Michael L. Gill, Westlake, Ohio

[73] Assignee: Nordson Corporation, Westlake, Ohio

[ * ] Notice: The term of this patent shall not extend beyond the expiration date of Pat. No. 5,421,921.

[21] Appl. No.: 379,182

[22] Filed: Jan. 27, 1995

Related U.S. Application Data

[62] Division of Ser. No. 911,674, Jul. 8, 1992, Pat. No. 5,418, 009.

[51] Int. Cl.[6] ..... B05C 11/00

[52] U.S. Cl. ..... 118/669; 118/324

[58] Field of Search ..... 118/410, 411, 118/324, DIG. 4, DIG. 2, 677, 669, 300, 308; 239/568, 597, 300, 297

[56] References Cited

U.S. PATENT DOCUMENTS

| | | |
|---|---|---|
| Re. 33,481 | 12/1990 | Ziecker et al. . |
| 1,747,581 | 2/1930 | Frazier . |
| 2,640,208 | 6/1953 | De Florez et al. . |
| 3,595,204 | 7/1971 | McIntyre . |
| 3,672,570 | 6/1972 | Scarbrough et al. . |
| 3,750,955 | 8/1973 | Nakai et al. . |
| 3,806,289 | 4/1974 | Schwarz . |
| 3,825,379 | 7/1974 | Lohkamp et al. . |
| 3,870,233 | 3/1975 | Wilhelm et al. . |
| 3,888,722 | 6/1975 | Blair et al. . |
| 3,956,057 | 5/1976 | Jung . |
| 3,972,759 | 8/1976 | Buntin . |
| 4,047,861 | 9/1977 | Balaz . |
| 4,059,714 | 11/1977 | Scholl et al. . |
| 4,128,667 | 12/1978 | Timson . |
| 4,133,970 | 1/1979 | Lusk . |
| 4,156,398 | 5/1979 | McDaniel . |

(List continued on next page.)

FOREIGN PATENT DOCUMENTS

| | | |
|---|---|---|
| 1125960 | 6/1982 | Canada . |
| 0161936 | 11/1995 | European Pat. Off. . |
| 2824403 | 12/1979 | Germany . |
| 89110046.3 | 8/1989 | Germany . |
| 0329813 | 3/1990 | Germany . |
| 0359943 | 3/1990 | Germany . |
| 54-170759 | 7/1981 | Japan . |
| WO9114510 | 10/1991 | WIPO . |

OTHER PUBLICATIONS 93110418.6 dated Sep. 1993 European Search Report.

The Waistband Phenomenon by Frederic McIntyre (No publication date available).

*Primary Examiner*—Brenda A. Lamb

*Attorney, Agent, or Firm*—Wood, Herron & Evans, L.L.P.

[57] ABSTRACT

Apparatus for producing intermittent, discrete patterns of coating material, such as hot melt adhesive, onto discrete substrates or substrate areas, such as book spines, sift-proof carton flaps and pinch-bottom bags. The adhesive patterns have sharp, square leading and trailing edges, as well as side edges. A slot nozzle die has elongated air slots along the slot extrusion opening. In the operation of the apparatus, the air flow is initiated from both air slots prior to the initiation of the hot melt flow. Also, the air flow is continued beyond that point in time, when the hot melt flow ceases. The delays between the operations of the air flow and the hot melt flow are on the order of micro seconds. Coating weights down to 1 gram per square meter at about 350 meters per minute substrate speed are provided. Alternatively, the lead and lag air start and stop times on each side of the film of coating material are different to control the exact disposition of the square cut-on and square cut-off coating edge on the substrate. Methods are disclosed.

37 Claims, 6 Drawing Sheets

U.S. PATENT DOCUMENTS

| | | |
|---|---|---|
| 4,247,581 | 1/1981 | Cobbs, Jr. et al. . |
| 4,289,330 | 9/1981 | Wiermanski . |
| 4,294,411 | 10/1981 | Hasting et al. . |
| 4,371,195 | 2/1983 | Wang et al. . |
| 4,408,562 | 10/1983 | DeCamp et al. . |
| 4,476,165 | 10/1984 | McIntyre . |
| 4,496,617 | 1/1985 | Parker . |
| 4,512,945 | 4/1985 | Vigano . |
| 4,553,701 | 11/1985 | Rehman et al. . |
| 4,627,465 | 12/1986 | Kolibas et al. . |
| 4,657,047 | 4/1987 | Kolibas . |
| 4,687,137 | 8/1987 | Boger et al. . |
| 4,714,647 | 12/1987 | Shipp, Jr. et al. . |
| 4,720,252 | 1/1988 | Appel et al. . |
| 4,735,169 | 4/1988 | Cawston . |
| 4,746,545 | 5/1988 | McIntyre . |
| 4,750,956 | 6/1988 | Malachowski . |
| 4,753,819 | 6/1988 | Shimada . |
| 4,774,109 | 9/1988 | Hadzimihalis et al. . |
| 4,778,631 | 10/1988 | Cobbs, Jr. et al. . |
| 4,815,660 | 3/1989 | Boger . |
| 4,818,464 | 4/1989 | Lau . |
| 4,830,055 | 5/1989 | Kolibas . |
| 4,836,440 | 6/1989 | French . |
| 4,850,514 | 7/1989 | Scholl et al. . |
| 4,874,451 | 10/1989 | Boger et al. . |
| 4,880,663 | 11/1989 | Shimada . |
| 4,891,249 | 1/1990 | McIntyre . |
| 4,900,390 | 2/1990 | Colton et al. . |
| 4,900,593 | 2/1990 | Krippl . |
| 4,906,492 | 3/1990 | Groshens . |
| 4,957,783 | 9/1990 | Gabryszewski . |
| 4,983,109 | 1/1991 | Miller et al. . |
| 4,983,424 | 1/1991 | Saidman et al. . |
| 4,984,949 | 1/1991 | Reckziegel . |
| 5,000,112 | 3/1991 | Rothen et al. . |
| 5,012,980 | 5/1991 | Viannay et al. . |
| 5,016,812 | 5/1991 | Pedigrew . |
| 5,145,689 | 9/1992 | Allen et al. . |
| 5,209,410 | 5/1993 | Wichmann et al. . |
| 5,236,641 | 8/1993 | Allen et al. . |
| 5,269,670 | 12/1993 | Allen et al. . |

APPARATUS FOR INTERMITTENTLY APPLYING DISCRETE ADHESIVE COATINGS

This application is a divisional of application Ser. No. 07/911,674, filed Jul. 8, 1992, now U.S. Pat. No. 5,418,009.

This case is generally related to the following United States Patent Applications filed on Jul. 8, 1992:

| Title | Inventors |
|---|---|
| Apparatus & Methods for Applying Discrete Coating Serial No. 07/910,781, now abandoned | J. Benecke; A. Cieplik; T. Burmester |
| Segmented Slot Die for Air Spray of Fibers Serial No. 07/910,784 now U.S. Pat. No. 5,421,921 | M. Gill; J. Benecke; A. Cieplik; T. Burmester |
| Apparatus & Methods for Applying Discrete Foam Coatings Serial No. 07/910,768, now abandoned | J. Raterman; J. Benecke; A. Cieplik; T. Burmester; M. Gill |
| Apparatus & Methods for Applying Conformal Coatings to Electronic Circuit Boards Serial No. 07/910,686, now U.S.Pat. No. 5,354,378 | B. Boger; J. Benecke; A. Cieplik; T. Burmester; M. Gill |
| Methods & Apparatus for Applying coatings to Bottles Serial No. 07/910,782 now abandoned | L. Hauser; J. Benecke; A. Cieplik; T. Burmester; M. Gill; K. Washington; R. Evans |

Such applications are all commonly assigned and are expressly incorporated herein by reference.

This invention relates to the application of coatings to substrates and more particularly to the application to substrates of discrete, uniform coatings having sharp and square cut-on and cut-off edges.

Many industrial applications require the use of discrete, well defined and uniform adhesive coatings applied to predetermined areas. Such coatings are very useful in varied lamination processes, such as in book binding, sift-proof carton sealing and pinch-bottom bags, for example, and in other coating operations.

In the production of discrete coatings and adhesives for lamination of discrete substrate areas, for example, it is desirable to obtain broad, uniformly thick coatings in a non-contact application process with sharp and square cut-on and cut-off edges with no stringing of material. None of the processes currently known are entirely suitable for this application.

Many various devices have been used to apply adhesives for lamination, including contact coaters, spray coaters, and, more recently, fine line or spiral pattern application devices. Contact coaters present the inherent disadvantage of wear and substrate index and tension tolerances. The spray, fine line and spiral pattern applicators do not generally produce highly defined square edge cut-on and cut-off coating edges in a uniform broad coating, as are desired in a number of applications.

While not related to lamination applications generally, another technique used for producing fibrous non-woven webs is known as a melt-blowing process. One such example of the melt-blowing process is described in U.S. Pat. No. 4,720,252. In that device, hot melt thermoplastic material is extruded from a continuous slot opening and air is blown onto the extruding material from both sides of the slot opening to produce the desired webs. Such processes are used for web production, and do not generally concern themselves with intermittent operation to produce discrete coatings, nor with extruding adhesives for lamination applications.

As noted above, there are numerous adhesive and sealing applications and processes which can benefit from the use of square, sharp, cut-on and cut-off patterns.

For example, in book binding, adhesives are used to adhere a cover to a book spine. But that spine can be curved, and its curved discrete shape is not conducive to existing spray or slot technologies. Multi-orifice nozzles present clogging and maintenance issues. In sift-proof cartoning, it is necessary to apply an integral adhesive pattern of uniform thickness, without breaks, to ensure there is no channel for the escape of fine granules or particulates packaged. In pinch-bottom bags, it is desirable to apply uniform patterns consistently on an intermittent production basis to cover particular predetermined discrete areas.

In all of these applications, it is desirable to obtain the necessary coatings without an applicator contact operation to reduce wear, yet while eliminating stringing of adhesive.

Accordingly, it has been one objective of this invention to produce broad, uniform, hot melt adhesive coatings with sharp side edges and sharp, square leading and trailing edges on intermittently presented discrete substrate areas for sealing.

Another objective of this invention has been to provide methods and apparatus for intermittent non-contact application of thermoplastic adhesive coating material, having sharp, square, side, leading and trailing edges, to discrete, predetermined areas.

To these ends, a preferred embodiment of the invention includes application of discrete adhesive patterns on predetermined substrate areas by means of a slot die means including a slot nozzle, elongated air channels on each side of the slot nozzle for impinging a flow of air on each side of an expanse of adhesive coating material extruding from the slot nozzle, and means for controlling the supply of material to the slot nozzle and the supply of air to the air channels so that each can be initiated and stopped at predetermined intervals to produce sharp, square leading and trailing edges in the deposited coatings.

In one mode, the air start-up on both sides precedes extrusion start-up and continues until after the extrusion is stopped. In another mode, the air on one side of the nozzle is started before extrusion is started and terminates before extrusion is stopped while air on another side of the nozzle starts at or after extrusion start-up and continues until after extrusion stops.

Continuation of air flow after extrusion stoppage can draw coating material remaining at or in the nozzle into the air stream and onto a substrate, causing stringing. Accordingly, the delay of air stoppage after extrusion stoppage is predetermined to produce good sharp, square coating pattern cut-off, but not so long as to draw remaining glue at the nozzle therefrom so as to cause stringing. The air start-up and stop delays are preferably on the order of microseconds.

The invention produces uniform, wide or broad coatings having sharp side edges and sharp, square, leading and trailing edges coordinated with a predetermined underlying substrate area and applied in a non-contacting application process.

When used in book binding, the adhesive coatings herein do not string down the book sides. When used in sift-proof cartoning, uniform adhesive patterns with sharp cut-on and cut-off leave no channels or openings for sift-through of granular or particulate product. And when used with pinch bottom bags, the uniform discrete coatings described herein produce sealing in the precisely defined substrate areas with no wear of contacting adhesive applicator parts.

These and other objectives and advantages will become readily apparent from the following detailed description of a preferred embodiment of the invention and from the drawings in which:

DETAILED DESCRIPTION OF THE PREFERRED AND ALTERNATE EMBODIMENTS

Figure 1:
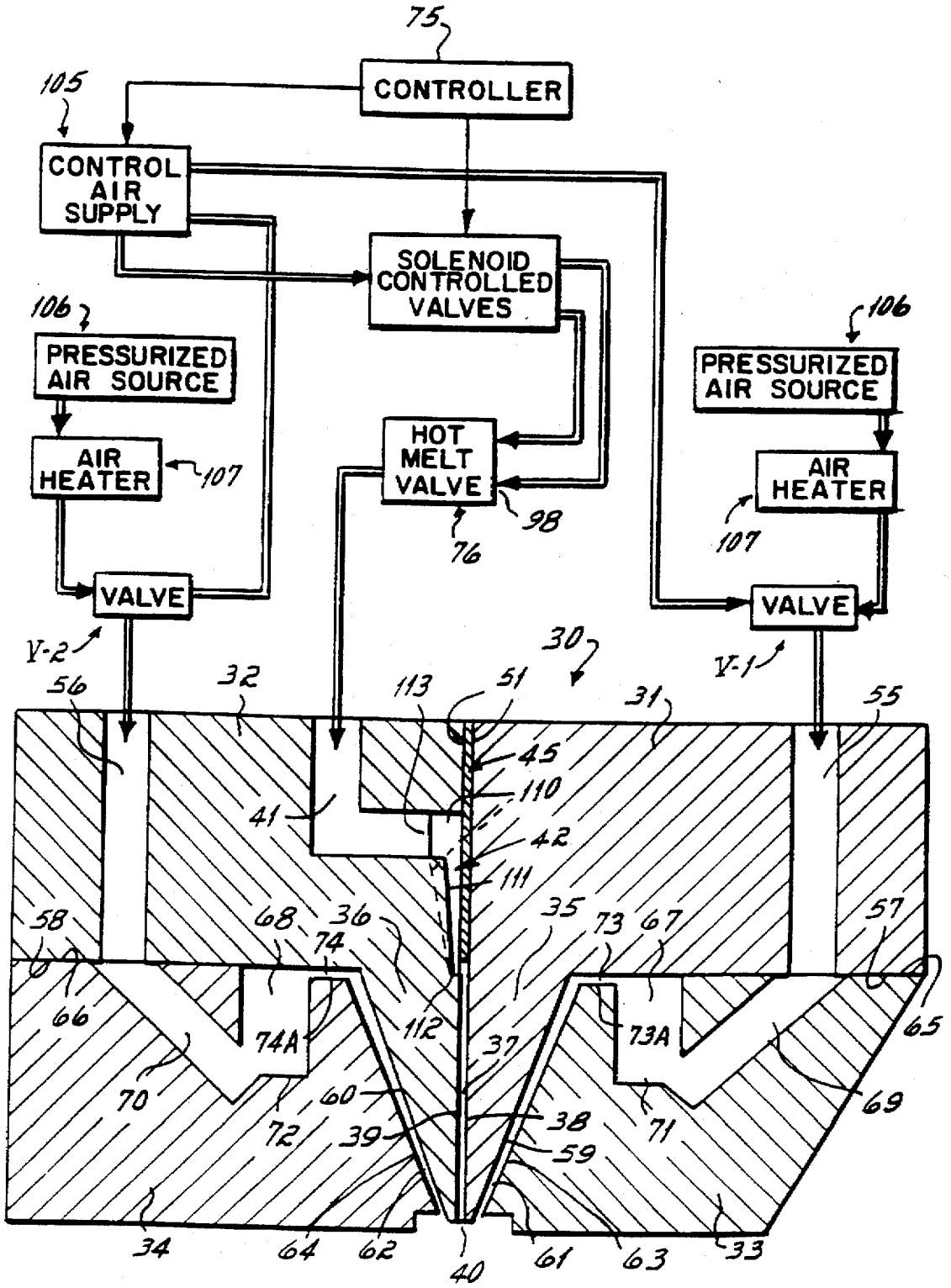
FIG. 1 is a diagrammatic side view in partial cross-section illustrating the invention.

Turning now to the drawings, there will now be described the apparatus for generating discrete, uniform coatings having sharp and square cut-on and cut-off edges. FIG. 1 illustrates various features of a die means 30 and air and hot melt adhesive controls according to the invention. The die means 30 comprises two die halves 31, 32, and two air blocks 33, 34. Each die block 31, 32 includes a downwardly depending projection 35, 36. The die halves 31, 32 define between them an extrusion slot 37. Slot 37 is defined by the face 38 of the die half 31 and the face 39 of the die half 32. Face 38 is juxtaposed with respect to the face 39, as shown. The extrusion slot 37 terminates at an elongated slot nozzle or extrusion outlet 40.

As noted in the Figures, the air blocks extend below the outlet 40 to provide a degree of protection from mechanical damage.

Figure 4:
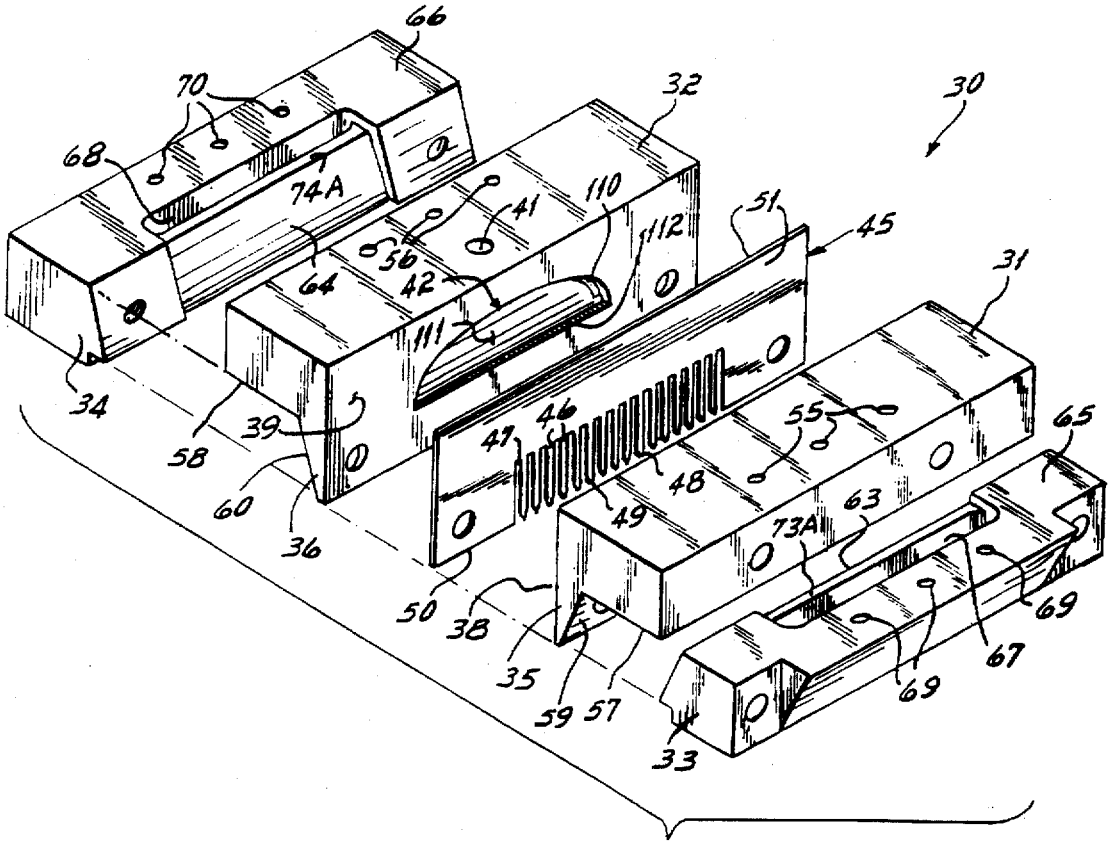
FIG. 4 is an exploded view of the slot nozzle die of FIG. 2.
Figure 6:
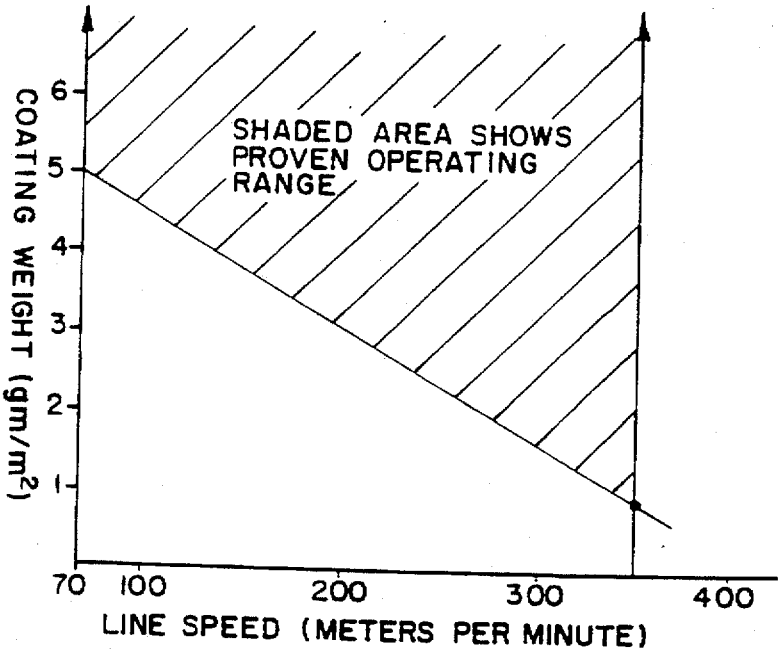
FIG. 6 is a graph illustrating coating weight applied vs. substrate line speed for a coater according to the invention.

Die half 32 includes a hot melt passageway 41 for receiving hot melt adhesive and conducting the hot melt adhesive to a "coat hanger" portion 42 of the die half 32, details of which are perhaps better seen in FIG. 4. A slotted or segmented shim 45, as best seen in FIG. 6, and a portion of which is seen in FIG. 1, is located between the juxtaposed surfaces 38 and 39 of the die halves 31 and 32. The shim 45 has a plurality of elongated projections 46, defining between them a plurality of elongated channels or slots 47.

Figure 5A:
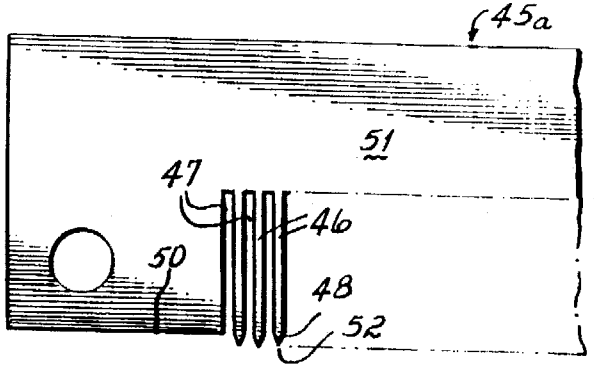
FIG. 5A is a partial view of an alternative shim.

Each of the projections has a downstream tapered end portion 48, having a pointed tip 49 which is flush with the lower edge 50 of the shim, and flush with the elongated slot nozzle extrusion outlet 40 (FIG. 1). In FIG. 1, only the top portion 51 of the shim 45 is shown, for the purpose of clarity. Alternatively, an open shim with no projections 46 can be used. Also, another alternative shim is **45*a*, illustrated in FIG. 5A. Pointed tips 52 extend beyond slot outlet 40**, preferably about two or three thousandths of an inch.

Returning now to FIG. 1, each of the upper die halves 31, 32 is provided with an air passageway 55, 56, extending from an upper surface of the die to a lower respective surface 57, 58. Each die half 31, 32 also includes an inclined surface 59, 60, depending from the surfaces 57 and 58, respectively. The inclined surfaces 59 and 60 define one part of an air passage, or air slot 61 and 62, as will be described.

Turning now to the air blocks 33 and 34, it will be appreciated that each of them include an inclined surface 63 and 64, respectively, which define the other side of the air slots 61 and 62 with the juxtaposed respective surfaces 59, 60, all as shown in FIG. 1. Each of the air blocks 33 and 34 include an upper surface 65, 66 juxtaposed to the respective lower surfaces 57 and 58 of the die halves 31, 32.

An elongated air plenum 67, 68 is formed in each of the air blocks 33, 34. The plenums 67, 68 are also seen in FIG. 4. Respective air passages 69 and 70 are formed in the respective air blocks 33 and 34 and extend from the respective surfaces 65 and 66 to a lower portion 71, 72 of the respective plenums 67, 68. Each of the plenums 67, 68 are primarily defined in the air blocks 33 and 34. However, when the die means 30 are assembled, the top area of each of the respective plenums 67, 68 are defined respectively by the lower surfaces 57 and 58 of the die halves 31, 32. These surfaces 57, 58 also form an upper portion of air passage 73 and 74, each of which respectively lead from their associated plenums 67 and 68 to the air slots 61 and 62. Accordingly, looking at the right hand side of FIG. 1, it will be appreciated that air can pass through the passageway 55 to the passageway 69 in air block 33, and from there to the plenum 67. "O"-rings, not shown, can be used at the interfaces of the respective die half and air block to seal passages 55, 56 with passages 69, 70, respectively. Pressurized air in the plenum 67 moves through the passageway 73 into the air slot 61.

In a like manner, air can be introduced to passageway 56 in the die half 32 and from there it can move into the air passageway 70 and into the lower portion of the plenum 68. From the plenum 68, pressurized air is directed through the air passage 74 into the air slot 62 of the air block 34.

Referring now briefly to the upper portion of FIG. 1, it will be appreciated that a controller 75 is operationally connected to valves V-1 and V-2, as shown, for controlling the introduction of heated, pressurized air to the passages 55 and 56, respectively, in order to pressurize those passages and the downstream air passages as previously described, with air. At the same time, the controller 75 is operationally interconnected to a hot melt control valve 76 for controlling the supply of coating material, such as hot melt adhesive, to the hot melt adhesive passage 41 and to the internal coat hanger area 42 of the die means 30. While any suitable form of controller 75 can be used, as is well known, one particular controller comprises a PC-10 pattern controller, manufactured by Nordson Corporation of Westlake, Ohio. The PC-10 pattern control 75 is operational to initiate and to stop the generation of air into passages 55 and 56, either simultaneously or independently, and also to initiate and to stop the hot melt flowing through valve 76 so as to intermittently provide coating material to the passageway 41 independently and at pre-selected times with respect to the provision of pressurized heated air to the passages 55 and 56, all in a manner as will be described.

The air slots 61 and 62 are oriented on an angle with respect to the elongation of the extrusion slot 37. Accordingly, when coating material is extruded through the slot 37 and outwardly of the extrusion outlet 40, air moving through the air slots 61 and 62 is impinged on the material before that material engages or is deposited on an underlying substrate which is presented for coating.

Figure 2:
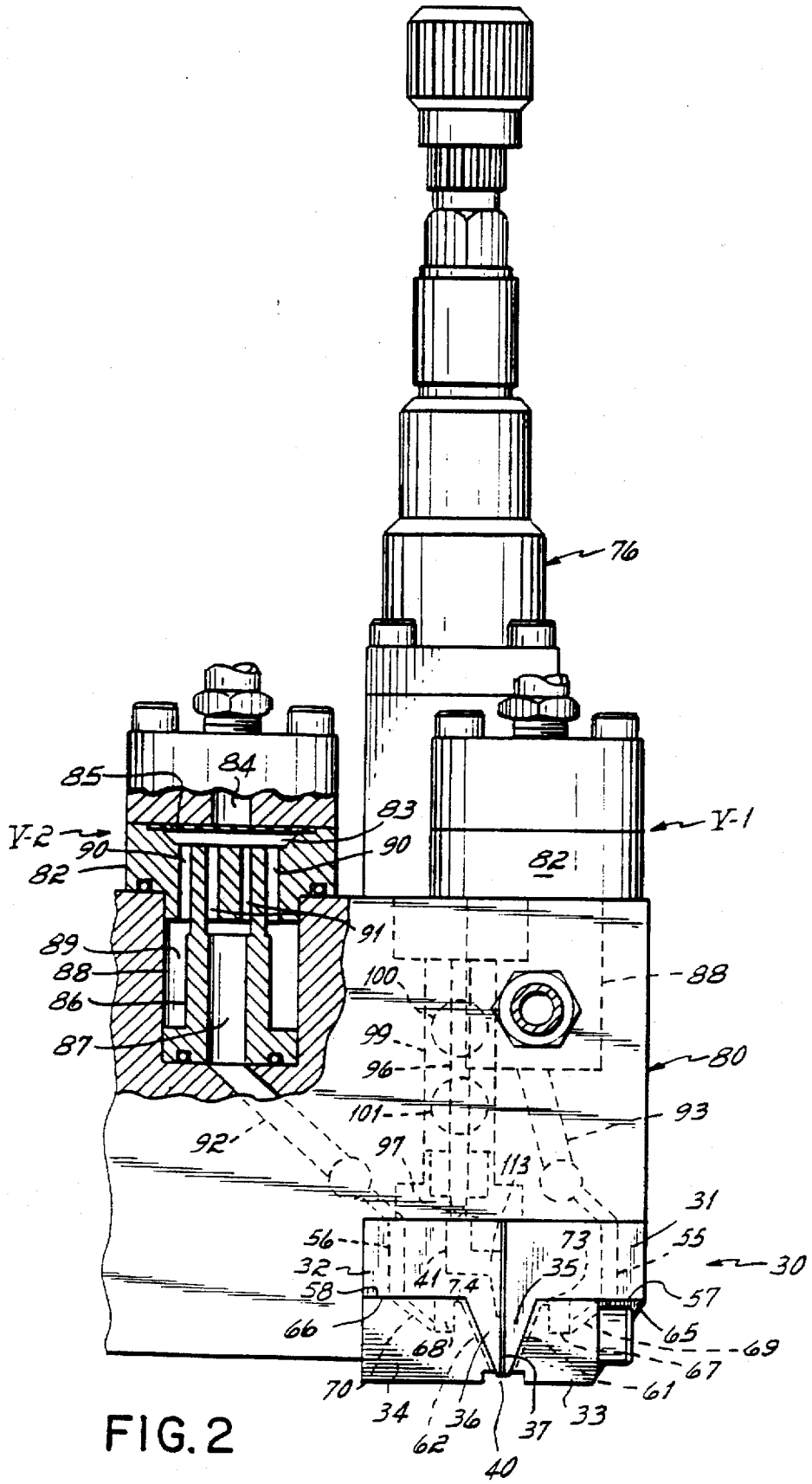
FIG. 2 is an elevational side view in partial cross section of a slot nozzle coater according to the invention.
Figure 3:
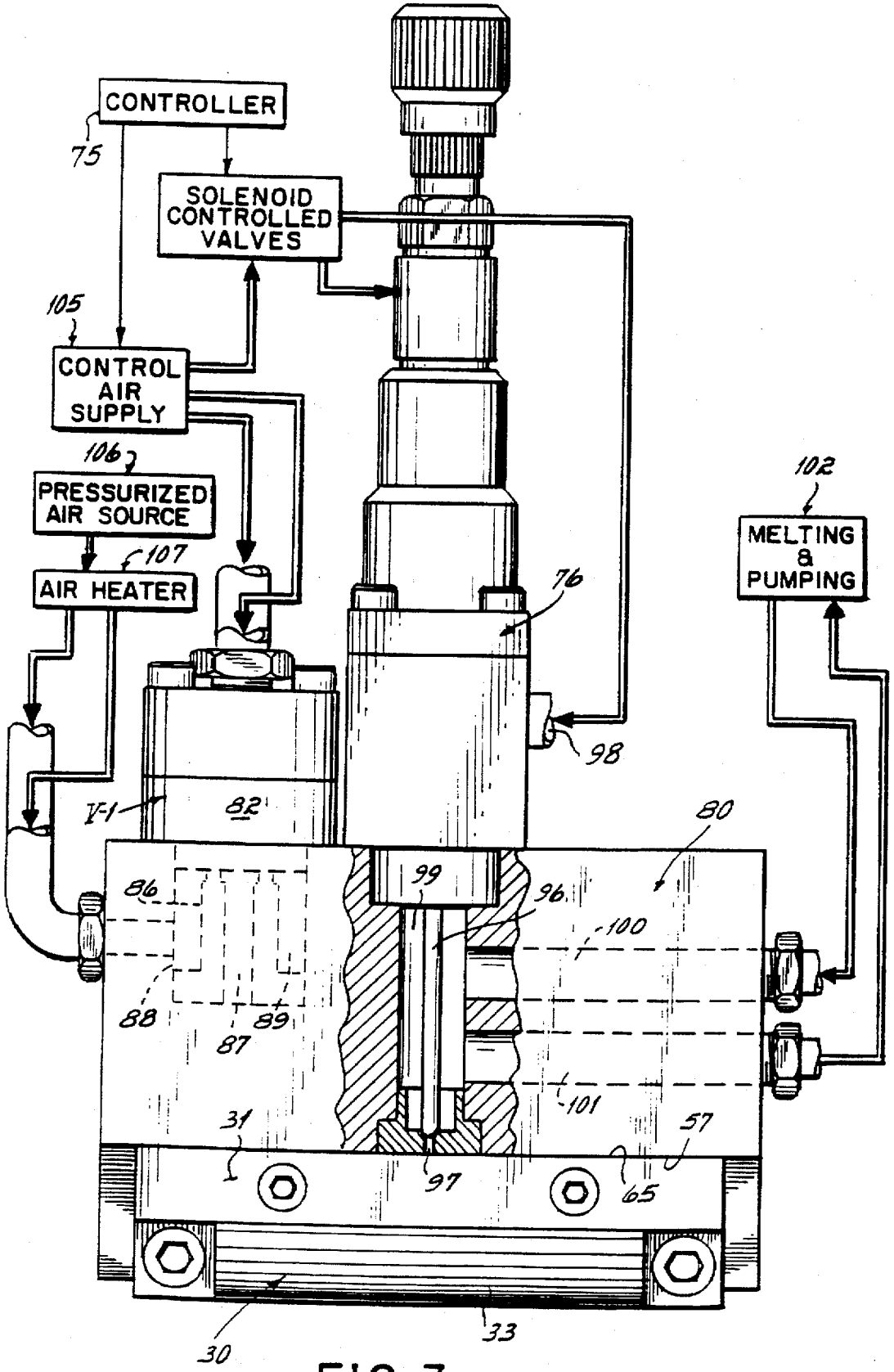
FIG. 3 is an elevational front view in partial cross-section of the apparatus of FIG. 2, illustrating diagrammatically control and flow features of the invention.

Turning now to FIGS. 2 and 3, there is shown more of the overall extrusion apparatus according to the invention. As shown in FIG. 2, the die means 30 is interconnected with air valves V-1, V-2 and hot melt valve 76, each of which is interconnected with an extrusion body 80 which operationally interconnects the air and hot melt valves with the die means 30.

For clarity, a portion of the air valve V-2 is shown in partial cross section in FIG. 2. Since the valves V-1 and V-2 are identical, only valve V-2 will be described. Such air valves are manufactured and distributed by Nordson Corporation through Nordson Engineering of Luneburg, Germany, under part no. 265701. Any other suitable air valve can be used.

Valve V-2 comprises a valve body 82 defining a valve chamber 83 and a control chamber 84, the two chambers being separated by the diaphragm 85. An extension 86 having a bore 87 extending therethrough depends from the valve body 82 and extends into the bore 88 of extrusion body 80 to form an annular chamber 89 therewith. Chamber 89 is interconnected with an annular passageway 90 in the valve body 82, which interconnects with the chamber 83. An annular chamber 91 is also defined in the valve body 82 and interconnects with the chamber 83. When control air is directed into chamber 84, the diaphragm 85 is pushed downwardly to seal off the annular passage 90 from the annular passage 91. On the other hand, when pressure is decreased in the control chamber 84, the diaphragm moves upwardly to the position shown in FIG. 3. Air in the inlet annular chamber 89, which is heated and under pressure, communicates through the annular passages 90 through the chamber 83 and the annular passage 91, into the outlet bore 87. Outlet bore 87 is connected through a passageway 92 to the air passage 56 in the upper die half 32, as shown in detail in FIG. 1, where the air from there can move to the plenum 68 and into the air slot 62.

In like manner, the air valve V-1 is operable to selectively supply air to the air passage 93 in the extrusion body 80 and from there to the air passage 55 in the upper die half 31. Air moves through that passageway 55 into the plenum 67 and from there to the air slot 61.

The hot melt valve 76 can be any suitable hot melt valve which can be selectively controlled to initiate and to cut off the flow of coating material, such as hot melt adhesive, to the die means 30. One such suitable valve is balanced valve model no. EP51 produced by Nordson Corporation of Westlake, Ohio. Such valve minimizes significant change in pressures when the valve is switched between its opened and closed positions. The valve 76 has a stem 96 seated over a port 97. When control air is supplied to an inlet 98, the stem 96 is lifted to permit hot melt adhesive in a chamber 99 to flow through the port 97 and into the hot melt passageway 41 of the upper die half 32. Hot melt adhesive is introduced into the chamber 99 through hot melt inlet 100. A hot melt outlet 101 is also interconnected with the chamber 99 to receive pressurized hot melt adhesive when the stem 96 is seated on port 97.

Any suitable apparatus can be utilized for melting and pumping hot melt adhesive to the valve 76. Such apparatus is shown diagrammatically at 102. While any suitable apparatus could be utilized, one particular form of apparatus which is suitable is the model HM640 applicator, manufactured by Nordson Corporation of Westlake, Ohio.

FIG. 3 illustrates diagrammatically the various control inputs to the valves 76 and V-1. As shown in FIG. 3, the controller 75 is interconnected to a control air supply 105 for supplying control air to the valves V-1 and V-2. A pressurized air source 106 is interconnected to an air heater 107 which supplies process air to the valves V-1 and V-2 for transmission to the respective air slots 61, 62, as described above. When the respective valves V-1 and V-2 are opened, controller 75 is also interconnected to the control air supply for supplying control air through closed and opened solenoid control valves (shown in FIG. 3) to open and close the hot melt valve 76.

Referring now more particularly to FIG. 1 and the details of the die means 30 as shown in FIG. 4, it will be appreciated that the plenums 67 and 68 in the air blocks 33, 34 communicate with the lower surfaces 73A and 74A, respectively, of the air passages 73 and 74 as previously described, and air emanating from the upper portion of the plenums 67 and 68 moves through the passageways 73 and 74 and then downwardly through the respective air slots 61, 62.

Turning now to the so-called "coat hanger" portion 42 of the upper die half 32, and with reference to FIG. 4, it will be appreciated that "coat hanger" dies are known in general. For example, one coat hanger-type die for handling hot melt adhesive is disclosed in U.S. Pat. No. 4,687,137, expressly incorporated herein by reference. The difference in that structure is that it serves a plurality of die outlets, and not a continuous extrusion slot die as noted herein. While such a die could be used herein, nevertheless, the present die means 30 incorporates a "coat hanger" portion 42 having an arcuate slot or groove of increasingly shallow dimension 110 communicating with an incline surface 111. Surface 111 is inclined such that its lower portion, where it meets bottom surface 112, is closer to the plane of the face 39 than is the upper portion. It will also be appreciated that slot 110 is of decreasing depth as its distance from port 113 continues until it flows unbroken in surface 111. The arcuate slot 110 of decreasing depth is fed by the hot melt port 113, which is interconnected to the hot melt passage 41. In use, when hot melt is supplied at pressure to the passage 41, it exudes through the port 113 into the arcuate slot 110 and from there flows over the surface 111 and spreads out throughout the relieved coat hanger shaped portion 42 of the die face 39 and the side of the shim 45 which is juxtaposed to the face 39 of the die half 32.

It will be appreciated that the slots 47 of shim 45 have upper ends which communicate with the lower portion of the coat hanger die area 42, just above the surface 112 thereof, so that hot melt adhesive or other coating material can flow into the slots 47 and then downwardly to the extrusion outlet 40. In this manner, the coating material is spread throughout the coat hanger portion 42 and across each of the upper ends of the slots 47 of the shim 45 at significantly equal pressures, so that coating material can move through the extrusion slot 37 within the slots 47 of the shim 45 at relatively equal pressures.

Figure 5:
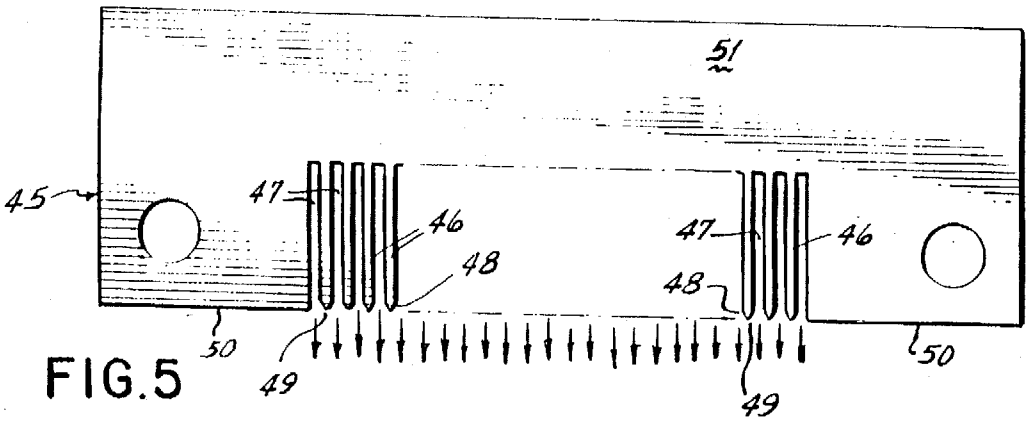
FIG. 5 is a front view of the slotted or segmented shim used in the slot nozzle die of the invention.

As diagrammatically illustrated in FIG. 5, the material exudes through the slots 47 and then outwardly of the extrusion outlet 40.

Considering the advantages of the segmented shim 45, it will be appreciated that the width of the slots 47 between the projections 46 is preferably about twice the thickness of the shim. The thickness of one shim 45 may be about 0.004" while the slot width, i.e. from one projection 46 across to the next projection 46, is about 0.008". In another shim 45, for example, the shim thickness is about 0.008" while the segmented slot width between juxtaposed projections is about 0.016".

Accordingly, the overall slot thickness between die faces 38, 39 can be doubled while the die still produces the same basis weight coating as a prior slot die where the die slot is not segmented, as in this invention. Thus in a prior slot die where a slot thickness of 0.002" was needed for a small basis weight coating, the present invention can obtain the same basis weight coating with a slot thickness of 0.004", or doubled. Thus, the slot die according to the invention could pass a potentially clogging particle of 0.003" while the prior continuous slot die would not (for the same basis weight coating to be produced).

While the ratio of the slot width to the shim thickness is preferably about 2 to 1, this ratio can be varied to produce varying coating thicknesses.

It will be appreciated that the width and thickness parameters of the shims 45, 45*a* and their components can widely vary. The parameters may vary due to the basis weight of coating per square meter desired, the cohesiveness desired, the coating material viscosity or other factors.

In order to provide further description of one form of coat hanger portion 42, the surface 112 from face 39 back to surface 111 is about 0.020" wide. The tops of slots 47 are about 0.050" when the shim is operably disposed between faces 38, 39. The groove 110 at its deepest depth from face 39 is about 0.125" from face 39. The surface 111 at its top area is about 1/16" deep from face 111 and about 0.020" back from surface 39 at its bottom. The coat hanger width across face 39 is about 38 mm.

It will be appreciated that the coating material may be precisely delivered to the heads or nozzles by one or more material metering means such as metering gear pumps. A single pump could feed a manifold for all the heads or nozzles or a separate metering gear pump could be used for each head or nozzle, or for a group of nozzles of less than all nozzles. This precise delivery permits accuracy in the material delivery so that accurate basis weight coatings can be provided for varying substrate speeds, for example. Any suitable form of metering feeds can be utilized. For example, U.S. Pat. Nos. 4,983,109 and 4,891,249, expressly incorporated herein by reference, disclose metering means for hot melt adhesives.

Turning now to the use of the apparatus described above, for the application of coatings to defined predetermined or discrete substrates, it will be appreciated that the apparatus is capable of impinging hot air from the slots 61 and 62 on each side of the coating material exuding from the extrusion outlet 40. The impinging air engages and carries the expanse of emerging material to the desired substrate, preferably in solid film format for the applications herein. Edge control is uniform and the density of the pattern can range from 25% open or fibrous to preferably 0% open, i.e. a non-pervious film as preferred for these applications. The parameters are selected depending on the application to which the coatings are to be applied. The controller 75 is operational to start and stop the application of air to the extruded coating material at different times and/or intervals compared to the starting and stopping of the delivery of hot melt adhesive to the extrusion outlet 40.

For example, in one preferred method of operation, the flow of air through the slots 61, 62 is started a short time prior to the time when the valve 76 is operated to initiate the delivery of coating material into the slot 37 and out through the outlet 40. The air is continued for the coating deposition. At the end of the deposition period, the valve 76 is first operated to cease the extrusion of coating material through the outlet 40. After a short delay, the flow of air through the slot 61 and 62 is stopped. While the amount of delay in such an operation will vary, depending upon the properties of the hot melt, such time period generally will preferably be on the order of micro seconds. One example would be, for example, 1700 micro seconds between the start up of the air and the start up of the extrusion of the hot melt material, and 2100 micro seconds between the stopping of the hot melt material and the stopping of the air. Continuation of the air flow much beyond this time might serve to pull off remaining hot melt adhesive at the extrusion outlet and cause stringing of the deposited coating.

Moreover, it will also be appreciated that the invention contemplates the selective applications of air flow through either slot 61 or 62 individually or together during the deposition period, particularly to more accurately define the initial and ending contact position of the deposited coating on the substrate. One such mode of operation is illustrated in FIG. 7, where the apparatus is utilized, for example, to apply a discrete coating to the spine of a book so that a cover can be applied or laminated thereto.

Figure 7:
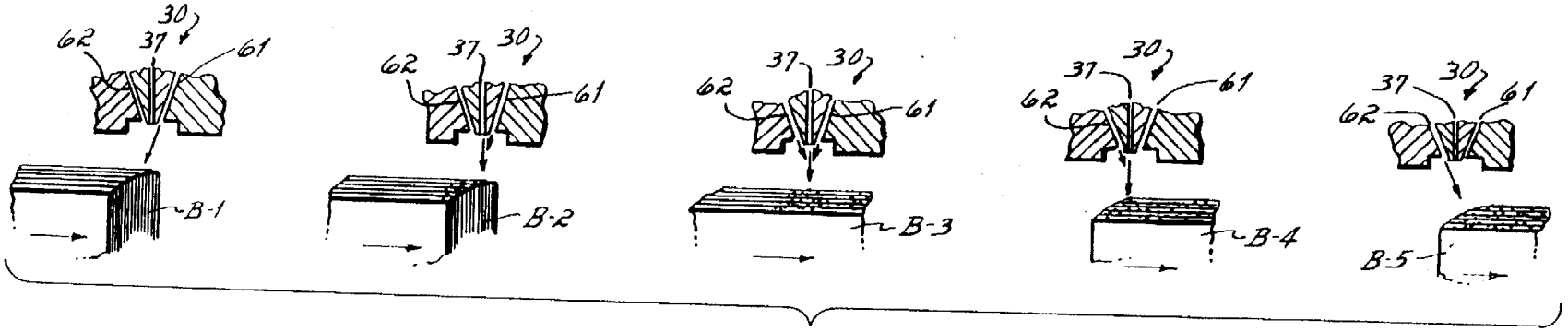
FIG. 7 is a diagrammatic view illustrating use of one embodiment of the invention in a book binding application.

In FIG. 7, it will be appreciated that a single book is shown in various positions moving past a die means 30. A plurality of books can be continuously passed by die means 30 for receiving a discrete, sharp edged coating on their respective spines. A book 120 having a curved spine 121 with no adhesive thereon is shown at the left hand side of the figure at position B-1. As illustrated at B-1, air flow has been initiated through slot 61 but there is no coating material being extruded through the slot 37 and no air flow has started through the air slot 62. Moving to the book at the position B-2, it will be appreciated that the hot melt flow has started and that it is impinged by air flowing through slot 61. Since the air flowing through slot 61 moves downwardly in a general right to left direction as shown in FIG. 7, it will be appreciated that the coating material does not string down the side of the book pages but that a coating 122 having a square, sharp leading edge 123 is applied directly to the edge of the spine of the book with no stringing. Thereafter, and for most of the remainder of the coating operation, as shown in book position B-3, air flow is initiated and continued through the slot 62. At the end of the coating operation, the air flowing through slot 61 is terminated just before termination of the extrusion of the coating material (position B-4). Then, as shown in position B-5, the coating material flow has ceased, while the air flowing through slot 62 continues for a short time period thereafter. This ensures a sharp, square trailing edge 124 in coating 122. This operation, when used in book binding, for example, would ensure that the adhesive will not string down the leading or rear sides or ends of the book.

Accordingly, with respect to FIG. 7, the lag air is started first and stopped first and the lead air, that is, with respect to the left-to-right machine direction of the application as shown in FIG. 7, is started after the extrusion of the coating material and stopped after the coating material extrusion has ceased. In this way, the air angling onto the coating material does not blow it in strings over the edges of the book, as would be undesirable and yet the cut-off and cut-on edges of the coating material are maintained in sharp, square fashion on the spine of the book.

Figure 8:
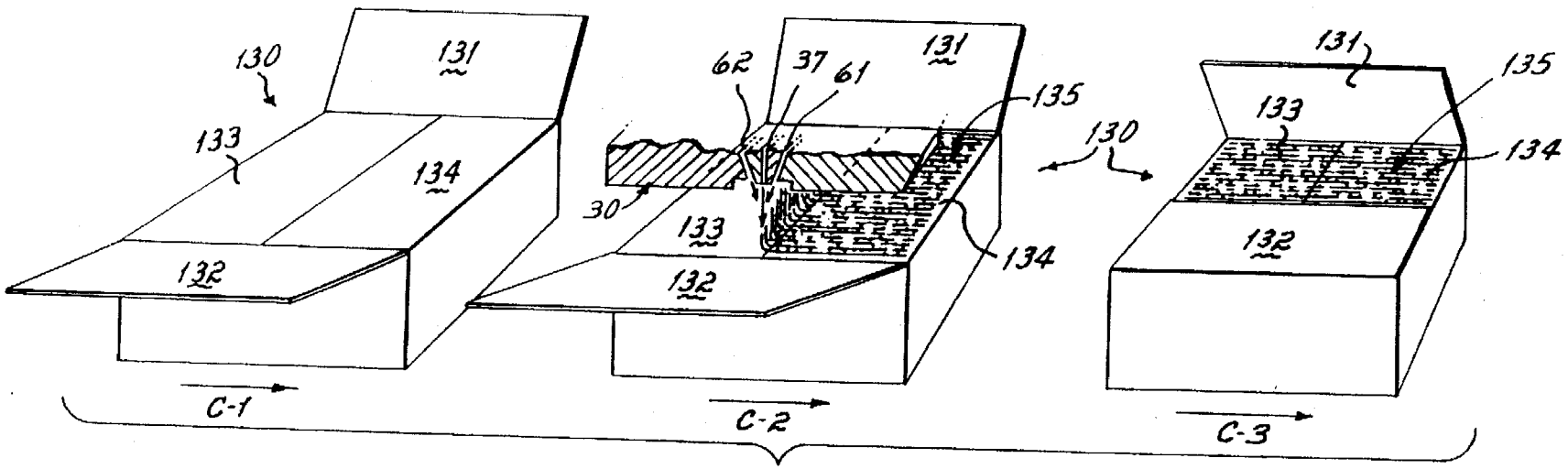
FIG. 8 is a diagrammatic view illustrating use of one embodiment of the invention in a sift-proof cartoning application.

Turning now to FIG. 8, there is illustrated therein, the intermittent application of broad, uniform, square, sharp edged discrete adhesive coatings to the flaps of sift-proof cartons 130, for the purpose of sealing the carton so there is no channel or opening in the seal therein, which would permit sifting out of granular or particulate materials therein.

Such sift-proof cartons are utilized for packaging many various products and various methods of sealing such cartons have been proposed. See, for example, the disclosures of U.S. Pat. Nos. 4,156,398; 4,735,169; 4,836,440 and 5,016,812.

In FIG. 8, a carton 130 is provided with upper flaps 131, 132, 133 and 134. Of course, the carton can be of any size and shape and, it is not necessary that the flaps opposed to each other, such as 131, 132, or 133, 134 overlap or actually meet at their ends when folded. Nevertheless, as shown in FIG. 8, the carton 130, at position C-1, has two flaps 133 and 134 folded, while flaps 131 and 132 are held (by means not shown) in an open position. At position C-2 in FIG. 8, it will be appreciated that the carton is conveyed beneath a slot nozzle die means 30, as described above, for the application of a uniform, integral coating 135 of adhesive to the upper surfaces of the flaps 134 and 133, as shown. Once the adhesive is applied to the upper surfaces of the flaps 134 and 133 as described heretofore, by operation of the slot nozzle die means 30 as described, the carton flaps 131 and 132 are folded and compressed onto the adhesive coating 135 to seal the undersides of the flaps 131, 132 to the adhesive layer 135 which has been applied to the flaps 133, 134.

Of course, many variations are possible. For example, the slot nozzle die means 30 could be provided to apply adhesive to the undersides of the carton flaps 131, 132, which could then be folded over onto the flaps 133, 134. In addition, the various operations as described above respecting the on/off delays of the air, and the sequential operation of the air through the slot 61 and 62, can be utilized, as noted above, to provide square and sharp cut-on and cut-off edges, i.e. leading and trailing edges, for the adhesive pattern 135, so the adhesive does not string down the sides of the cartons 130.

It will also be appreciated that either open or closed adhesive patterns can be utilized with the preferred closed patterns comprising preferably a solid web or film which will not provide any open channel or pathway through which the contents of the carton 130 might sift.

It will also be appreciated that it is not necessary to use any contacting coater apparatus in the application process, but rather that the adhesive is applied in a non-contact manner by the slot nozzle die means 30, as described above, so that a film of adhesive is carried to the carton flaps by the air flows, as also described above.

Figure 9:
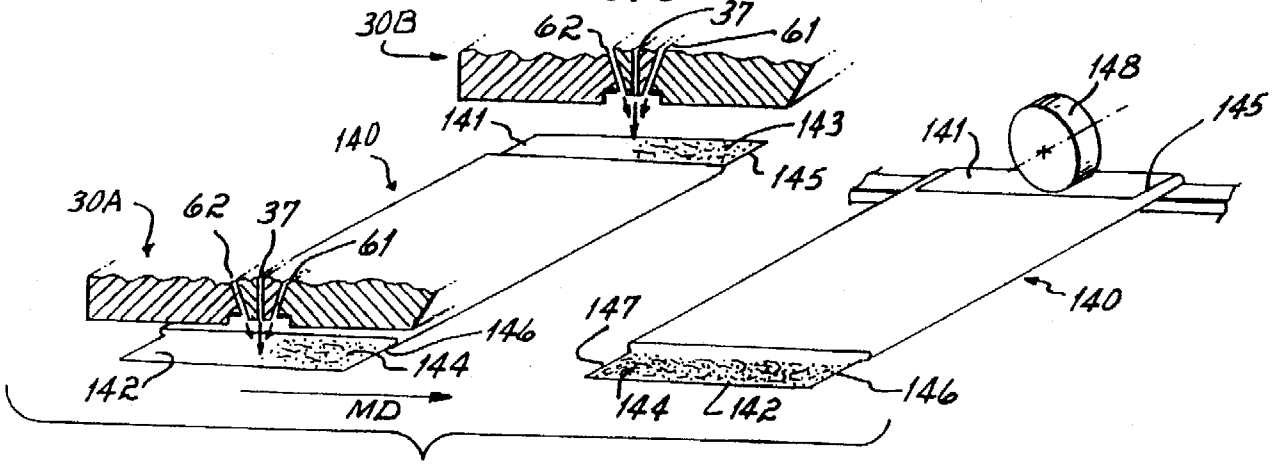
FIG. 9 is a diagrammatic view illustrating use of one embodiment of the invention in a pinch-bottom bag application.

Turning now to another form of application of adhesive coatings described herein, FIG. 9 illustrates the intermittent application of the discrete adhesive coatings in connection with the manufacture of pinch-bottom bags 140. A pinch-bottom bag can be generally defined as a single or multiple wall bag formed from a tube, for example, where, when pressed flat, one side of the tube is extended beyond the other and that side can be turned up and over on the opposite side and sealed thereto to form a bag bottom. In the manufacture of pinch-bottom bags, it is common to apply hot melt adhesive to a bottom seal flap and to a top seal flap. The bottom seal flap is folded over to seal the bag bottom, while the top flap is left open. Thereafter, the bag is filled and the top flap is then folded over and heat applied to seal the top flap to the bag.

As shown in FIG. 9 then, the pinch-bottom bag 140 has a bottom closure flap 141 and a top closure flap 142. Since these flaps are at opposite ends of the bag, it is advantageous to utilize two slot die means indicated at 30A and 30B according to the invention, for application of discrete uniform coatings 133 and 134 to the respective flaps 141 and 142. In FIG. 9, the bag 140 is moved in the machine direction, or left to right, beneath the slot nozzle die means 30-A and 30-B. When the forward edge is moved to a predetermined position, the coating operation is initiated so that the coatings 143 and 144 are applied to the flaps 141 and 142, respectively. As described above, the application process and the air are applied through the slots 37, 61 and 62, respectively, in order to define a sharp, leading edge such as 145, 146, respectively, in the coating beginning at the leading edges of the flaps 141, 142. Thereafter, the coating operation has ceased, leaving a sharp trailing edge 147, as shown on flap 142 at the righthand side of FIG. 9. At the same time, it will be appreciated that the flap 141 has been folded over and compressed by a sealing wheel or compression wheel 148 to adhere the flap 141 to the bottom of the bag 140. Flap 142 has been left unfolded so that the coating 144 can cure and be reactivated by heat after the bag 140 has been filled.

Accordingly, it will be appreciated that discrete coatings 143, 144 are applied to the bag flaps for sealing purposes, and that each coating has a sharp leading and trailing edge applied to a predetermined discrete area on the substrate flap. Bags 140 are introduced beneath the slot nozzle die means 30-A and 30-B consecutively, such that the coating operation is operated intermittently to produce well-defined, sharp, square edged, leading and trailing edges in the coatings for sealing. Alternatively, the bags could be moved under the slot nozzle in an end to end fashion and a different means used to fold up and compress the bottom flap 141 on the bag for sealing.

The invention is believed useful with a wide range of coating materials of different viscosities, as shown by the following two examples.

ADHESIVE NO. 1

This adhesive had the following viscosities at the following temperatures:

41,700 centipoise at 275 degrees F.

25,050 centipoise at 350 degrees F.

16,575 centipoise at 325 degrees F.

11,325 centipoise at 350 degrees F.

Operating temperature was at 180 degrees C. With a 0.1 millimeter thick shim in the head, the supply pressure was 20 BAR, the return pressure of the adhesive was 21 BAR, and the air pressure was 1.5 BAR. The air was turned on 2 millimeters of substrate travel before the adhesive and turned off 2 millimeters of substrate travel after the adhesive. Substrate line speed is about 150 meters/minute. This corresponds to the delay times of about 800 micro seconds. At these settings, the cut-on and cut-off were square and sharp and a coating weight was produced of 5 grams per square meter of uniform thickness.

ADHESIVE NO. 2

This adhesive had the following viscosities:

5,700 centipoise at 250 degrees F.

2,600 centipoise at 275 degrees F.

1,400 centipoise at 300 degrees F.

800 centipoise at 325 degrees F.

550 centipoise at 350 degrees F.

Operating temperature was 300 degrees F. Coating weight was 15 grams per square meter. Cut-on and cut-off were square and sharp with no stringing.

It is important in both these examples and other applications that the hot melt supply pressure and return pressure be maintained in a relationship, such that the differences of the two pressures are not more than 1 BAR.

In addition, it is believed, based on current information, that a minimum flow rate is required to produce a uniform pattern with square and sharp cut-ons and cut-offs. For example, in connection with a 38 millimeter wide pattern, it is possible to get down to at least 1 gram per square meter of coating weight at approximately 350 meters per minute of line speed. The graph in FIG. 6 illustrates coating weights which have been obtained with a 38 millimeter wide pattern deposited on a substrate moving at about from 70 meters per minute to about 350 meters per minute, with the shaded area of the graph (FIG. 6) illustrating the proven operating ranges at the lighter coating weights. For the specific applications herein, generally heavier coating weights are used.

As noted above, coatings are produced in varying weights. Such coatings can be varied from 0% open or impervious to about 25% open or porous. Impervious coatings are preferred for the applications herein.

It will be appreciated that various sizes, spacings, pressures and selections of materials can be utilized. Thus, for example, the hot melt might be started at 2 mm of substrate movement after air start up, and the air flow stopped at 5 mm of substrate movement beyond extrusion shut off, for substrate speeds of about 70 meters/minute.

It will also be appreciated that while the particular coating pattern produced by the apparatus and methods described above can either be porous (open) or impervious (closed or solid films), the closed coatings are preferred for the specific applications herein, and that the coating patterns are preferably produced in a discrete fashion on discrete substrates, for example, with good, square, sharp cut-on and cut-off and no stringing for the leading or trailing edges of the pattern, while at the same time, the sides of the pattern deposited are also parallel and sharp.

Accordingly, the invention provides for intermittent non-contact coating operation with sharp, square-edged patterns and no stringing for a variety of applications, including lamination of the substrate to which the patterns are applied to some other substrate or component.

These and other modifications and advantages of the invention will become readily apparent to those of ordinary skill in the art without departing from the scope hereof, and the applicant intends to be bound only by the claims appended hereto.

We claim:

1. Apparatus for intermittently applying discrete adhesive coatings to book spines, said apparatus comprising a slot nozzle having an elongated slot outlet through which an adhesive coating material can be extruded:

at least two air slots, one proximate each side of said slot outlet for impinging at least one air stream onto an adhesive coating material exuding from said slot outlet for carrying the adhesive coating material onto the book spine;

means for starting flow of the impinging air stream prior to extrusion of adhesive coating material from said slot outlet;

further including means for stopping flow of the impinging air stream after extrusion of the adhesive coating material has ceased; and further including means for delaying impinging air from one of said air slots until after the adhesive coating material exudes from said slot outlet and for continuing flow of air from said one slot until after extrusion of the adhesive coating material has ceased.

2. Apparatus as in claim 1 further including means for initiating flow of the impinging air stream from the other air slot before adhesive coating material is extruded and for ceasing flow of the impinging air stream from said other air slot before extrusion of the adhesive coating material ceases.

3. Apparatus for intermittently applying discrete adhesive coatings to book spines, said apparatus comprising a slot nozzle die comprising:

die halves defining an extrusion slot therebetween, said extrusion slot having an elongated slot outlet through which an adhesive coating material can be extruded said die halves having tapered projections with parallel inward facing surfaces forming said extrusion slot and tapered outer walls respective partially defining inward surfaces of two air channels disposed at an angle with respect to said extrusion slot;

said air channels forming air slots which are proximate to said slot outlet for impinging at least one air stream onto the adhesive coating material exuding from said slot outlet for carrying the adhesive coating material onto the book spine;

two air blocks, each having a tapered surface juxtaposed in operative disposition near one of said tapered outer wall such that one of said air channels is formed therebetween;

an air plenum in each said air block;

an air passage in each said air block interconnecting an upper portion of each said plenum with a respective said air channel;

a second air passage in each said air block for feeding air to a lower portion of each said plenum; and means for starting flow of the impinging air stream from at least one of the air slots prior to extrusion of the adhesive coating material from said slot outlet.

4. Apparatus as in claim 3, including an additional air passage in each die half, each die half air passage operationally interconnected with one of said air passages in said air blocks for feeding air to said plenum therein.

5. Apparatus as in claim 3 wherein said air passages for feeding said air channel are defined by juxtaposed surfaces of said respective die halves and air blocks.

6. Apparatus as in claim 3 wherein said respective air plenums are defined by juxtaposed surfaces of said respective die halves and air blocks.

7. Apparatus as in claim 3 further including a shim disposed between said die halves.

8. Apparatus for intermittently applying discrete adhesive coatings to book spines, said apparatus comprising a slot nozzle having an elongated slot outlet through which an adhesive coating material can be extruded;

at least one air slot proximate said slot outlet for impinging at least one air stream onto an adhesive coating material exuding from said slot outlet for carrying the adhesive coating material onto the book spine; and means for starting flow of the impinging air stream prior to extrusion of the adhesive coating material from said slot outlet;

wherein said slot nozzle includes an extrusion channel terminating at said slot outlet, and further includes shim means in said channel extending at least to said slot outlet for dividing said slot outlet into a plurality of extruding slot outlets from which the adhesive coating material exudes.

9. Apparatus as in claim 8 wherein said dividing means includes a shim having a plurality of juxtaposed elongated projections defining said plurality of said extruding slots therebetween, said projections having tapered ends terminating at said slot outlet.

10. Apparatus as in claim 9 wherein the distance between two of the juxtaposed elongated projections is about twice the thickness of said shim.

11. Apparatus as in claim 8 wherein said dividing means extends outwardly beyond said slot outlet.

12. Apparatus as in claim 11 wherein said dividing means includes a shim having a plurality of elongated juxtaposed projections defining said plurality of said extruding slots therebetween, said projections having ends tapered to a point extending beyond said slot outlet.

13. Apparatus for producing an adhesive coating for application to the spine of a book, said apparatus comprising:

a slot nozzle having an extrusion channel and an elongated slot outlet disposed along said channel through which adhesive coating material moving through said channel is extruded;

at least one air slot proximate said slot outlet for impinging at least one air stream onto the adhesive coating material exuding from said slot outlet to produce a continuous fibrous web of coating material; and means in said channel extending at least to said slot outlet and for dividing said slot outlet into a plurality of extruding slot outlets from which the adhesive coating material exudes;

wherein the adhesive coating material exuding from each said extruding slot outlet merges into the adhesive coating material exuding from adjacent slot outlets to form the continuous coating web prior to the impingement of air thereon.

14. Apparatus for producing an adhesive coating for application to a predetermined area of a sift-proof package, said apparatus comprising:

a slot nozzle having an elongated slot outlet through which an adhesive coating material can be extruded;

at least two air slots, one proximate each side of said slot outlet for impinging at least one air stream onto a coating material exuding from said slot outlet for carrying the coating material to a predetermined area of said sift-proof package for sealing said package against sifting of contents therefrom;

means for starting the impinging air stream flow of prior to extrusion of the coating material from said slot outlet;

further including means for stopping the impinging air stream flow of after extrusion of the coating material has ceased; and including means for delaying impinging air from one of said air slots until after the coating material exudes from said slot outlet and for continuing flow of air from said one slot until after extrusion of the coating material has ceased.

15. Apparatus as in claim 14 further including means for initiating flow of the impinging air stream from the other air slot before the coating material is extruded and for ceasing flow of the impinging air stream from said other air slot before extrusion of the coating material ceases.

16. Apparatus for producing an adhesive coating for application to a predetermined area of a sift-proof package, said apparatus comprising:

a slot nozzle die comprising:

die halves defining an extrusion slot therebetween, said extrusion slot having an elongated slot outlet through which an adhesive coating material can be extruded said die halves having tapered projections with parallel inward facing surfaces forming said extrusion slot and tapered outer walls respectively partially defining inward surfaces of two air channels disposed at an angle with respect to said extrusion slot said air channels forming air slots which are proximate to said slot outlet for impinging at least one air stream onto the adhesive coating material exuding from said slot outlet for carrying the adhesive coating material onto the predetermined area of said sift-proof package for sealing said shift-proof package against sifting of contents therefrom;

two air blocks, each having a tapered surface juxtaposed in operative disposition near one of said tapered outer wall such that one of said air channels is formed therebetween;

an air plenum in each said air block;

an air passage in each said air bock interconnecting and upper portion of each said plenum with a respective said air channel; and an air passage in each said air block for feeding air to a lower portion of each said plenum; and means for starting flow of the impinging air stream from at least one of the air slots prior to extrusion of the adhesive coating material from said slot outlet.

17. Apparatus as in claim 16, including an additional air passage in each die half, each die half air passage operationally interconnected with one of said air passages in said air blocks for feeding air to said plenum therein.

18. Apparatus as in claim 16 wherein said air passages for feeding said air channel are defined by juxtaposed surfaces of said respective die halves and air blocks.

19. Apparatus as in claim 16 wherein said respective air plenums are defined by juxtaposed surfaces of said respective die halves and air blocks.

20. Apparatus for producing an adhesive coating for application to a predetermined area of a sift-proof package, said apparatus comprising:

a slot nozzle having an elongated slot outlet through which an adhesive coating material can be extruded;

at least one air slot proximate said slot outlet for impinging at least one air stream onto the adhesive coating material exuding from said slot outlet for carrying the adhesive coating onto the predetermined area of said sift-proof package for sealing said package against sifting of contents therefrom; and means for starting flow of the impinging air stream prior to extrusion of the adhesive coating material from said slot outlet;

wherein said slot nozzle has an outlet slot and further including means disposed in said slot nozzle and extending at least to said slot outlet for dividing said slot outlet into a plurality of extruding slot outlets from which the adhesive coating material is extruded.

21. Apparatus as in claim 20 wherein said dividing means includes a shim having a plurality of juxtaposed elongated projections defining said plurality of said extruding slots therebetween, said projections having tapered ends terminating at said slot outlet.

22. Apparatus as in claim 21 wherein the distance between two of the juxtaposed elongated projections is about twice the thickness of said shim.

23. Apparatus as in claim 20 wherein said dividing means extends outwardly beyond said slot outlet.

24. Apparatus as in claim 23 wherein said dividing means includes a shim having a plurality of elongated juxtaposed projections defining said plurality of said extruding slots therebetween, said projections having ends tapered to a point extending beyond said slot outlet of said slot nozzle.

25. Apparatus for producing an adhesive coating for application to a predetermined area of a sift-proof package, said apparatus comprising:

a slot nozzle having an elongated slot outlet through which an adhesive coating material can be extruded;

at least one air slot proximate said slot outlet for impinging at least one air stream onto the coating material exuding from said slot outlet for carrying the coating material to a predetermined area of said sift-proof package for sealing said package against sifting of contents therefrom; and means for starting flow of the impinging air stream prior to extrusion of the coating material from said slot outlet;

wherein said slot nozzle includes an elongated extrusion channel terminating at said elongated slot outlet and through which the coating material moving through said channel is extruded; and means in said channel extending at least to said slot outlet and for dividing said slot outlet into a plurality of slot outlets from which the coating material exudes;

wherein the coating material exuding from each of said plurality of slot outlets merges into coating material exuding from adjacent slot outlets to form a continuous coating web prior to impingement of air thereon.

26. Apparatus for producing discrete adhesive coatings on pinch bottom bags, said apparatus comprising:

a slot nozzle having an elongated slot outlet through which an adhesive coating material can be extruded;

at least two air slots, one proximate each side of said slot outlet for impinging at least one air stream onto a coating material exuding from said slot outlet for carrying the coating onto the to a predetermined area of said pinch bottom bag for sealing said pinch bottom bag; and means for starting flow of the impinging air stream prior to extrusion of coating material from said slot outlet;

further including means for stopping flow of the impinging air stream after extrusion of coating material has ceased; and further including means for delaying impinging air from one of said air slots until after the coating material exudes from said slot outlet and for continuing flow of air from said one slot until after extrusion of the coating material has ceased.

27. Apparatus as in claim 26 further including means for initiating flow of the impinging air stream from the other air slot before the coating material is extruded and for ceasing flow of the impinging air stream from said other air slot before extrusion of the coating material ceases.

28. Apparatus for producing discrete adhesive coatings on pinch bottom bags, said apparatus comprising:

a slot nozzle die comprising:

die halves defining an extrusion slot therebetween, said extrusion slot having an elongated slot outlet through which an adhesive coating material can be extruded, said die halves having tapered projections with parallel inward facing surfaces forming said extrusion slot and tapered outer walls respectively partially defining inward surfaces of two air channels disposed at an angle with respect to said extrusion slot said air channels forming air slots which are proximate to said slot outlet for impinging at least one air stream onto the adhesive coating material exuding from said slot outlet for carrying the adhesive coating material onto said pinch bottom bag;

two air blocks, each having a tapered surface juxtaposed in operative disposition near one of said tapered outer wall such that one of said air channels is formed therebetween;

an air plenum in each said air block;

an air passage in each said air bock interconnecting an upper portion of each said plenum with a respective said air channel;

a second air passage in each said air block for feeding air to a lower portion of each said plenum; and means for starting flow of the impinging air stream from at least one of the air slots prior to extrusion of the adhesive coating material from said slot outlet.

29. Apparatus as in claim 28, including an additional air passage in each die half, each die half air passage operationally interconnected with one of said air passages in said air blocks for feeding air to said plenum therein.

30. Apparatus as in claim 28 wherein said air passages for feeding said air channel are defined by juxtaposed surfaces of said respective die halves and air blocks.

31. Apparatus as in claim 28 wherein said respective air plenums are defined by juxtaposed surfaces of said respective die halves and air blocks.

32. Apparatus for producing discrete adhesive coatings on pinch bottom bags, said apparatus comprising:

a slot nozzle having an elongated slot outlet through which an adhesive coating material can be extruded;

at least one air slot proximate said slot outlet for impinging at least one air stream onto the adhesive coating material exuding from said slot outlet for carrying the adhesive coating material onto the to a predetermined area of said pinch bottom bag for sealing said bag; and means for starting flow of the impinging air stream prior to extrusion of the adhesive coating material from said slot outlet;

wherein said slot nozzle has an outlet slot and further including means disposed in said slot nozzle and extending at least to said slot outlet for dividing said slot outlet into a plurality of extruding slot outlets from which the adhesive coating material is extruded.

33. Apparatus as in claim 28 wherein said dividing means includes a shim having a plurality of juxtaposed elongated projections defining said plurality of said extruding slots therebetween, said projections having tapered ends terminating at said slot outlet.

34. Apparatus as in claim 33 wherein the distance between two of the juxtaposed elongated projections is about twice the thickness of said shim.

35. Apparatus as in claim 33 wherein said dividing means extends outwardly beyond said slot outlet.

36. Apparatus as in claim 32 wherein said dividing means includes a shim having a plurality of elongated juxtaposed projections defining said extruding slots therebetween, said projections having ends tapered to a point extending beyond said slot outlet of said slot nozzle.

37. Apparatus producing discrete adhesive coatings on pinch bottom bags, said apparatus comprising:

a slot nozzle having an elongated slot outlet through which an adhesive coating material can be extruded;

at least one air slot proximate said slot outlet for impinging at least one air stream onto the coating material exuding from said slot outlet for carrying the coating material to a predetermined area of said pinch bottom bag for sealing said bag; and means for starting flow of the impinging air stream prior to extrusion of the coating material from said slot outlet;

wherein said slot nozzle comprises an extrusion channel terminating at said elongated slot outlet through which the coating material moving through said channel is extruded; and means in said channel extending at least to said slot outlet and for dividing said slot outlet into a plurality of slot outlets from which the coating material exudes;

wherein the coating material exuding from each said slot outlet merges into the coating material exuding from adjacent slot outlets to form a continuous adhesive coating web prior to impingement of air thereon.

* * * * *

UNITED STATES PATENT AND TRADEMARK OFFICE

CERTIFICATE OF CORRECTION

PATENT NO. : 5,685,911

DATED : November 11, 1997

INVENTOR(S) : John Raterman, et al.

It is certified that error appears in the above-identified patent and that said Letters Patent is hereby corrected as shown below:

In the Claims:

In claim 1, column 11, line 60 before "adhesive" insert --the--

In claim 14, column 13, line 43, delete "a" and insert therefor --the--

In claim 16, column 14, line 14 delete "shift-proof" and insert therefor --sift-proof--

In claim 16, column 14, line 21, delete "bock" and insert therefor --block--

In claim 16, column 14, line 21, delete "and" and insert therefor --an--

In claim 20, column 14, line 47 after "coating" insert --material-- as shown in the

UNITED STATES PATENT AND TRADEMARK OFFICE

CERTIFICATE OF CORRECTION

PATENT NO. : 5,685,911

DATED : November 11, 1997

INVENTOR(S) : John Raterman, et al.

It is certified that error appears in the above-identified patent and that said Letters Patent is hereby corrected as shown below:

In claim 26, column 15, line 40, after "coating" insert --material-- as shown in the In claim 26, column 15, line 40, after "the" delete --to--

In claim 26, column 15, line 36 delete "a" and insert therefor --the--

In claim 26, column 15, line 42 before "coating material" insert --the--

In claim 26, column 15, line 44 before "coating material" insert --the--

In claim 28, column 16, line 12 delete "bock" and insert therefor --block--

In claim 32, column 16, line 36 after "the" delete --to--

Signed and Sealed this

Eleventh Day of May, 1999

*Attest:*

Q. TODD DICKINSON

*Attesting Officer*

*Acting Commissioner of Patents and Trademarks*